US009354015B2

(12) United States Patent
Yehle

(10) Patent No.: US 9,354,015 B2
(45) Date of Patent: May 31, 2016

(54) STRING GUIDE SYSTEM FOR A BOW

(71) Applicant: Ravin Crossbows, LLC, Superior, WI (US)

(72) Inventor: Craig Thomas Yehle, Holmen, WI (US)

(73) Assignee: Ravin Crossbows, LLC, Superior, WI (US)

( * ) Notice: Subject to any disclaimer, the term of this patent is extended or adjusted under 35 U.S.C. 154(b) by 298 days.

(21) Appl. No.: 14/107,058

(22) Filed: Dec. 16, 2013

(65) Prior Publication Data

US 2015/0168093 A1 Jun. 18, 2015

(51) Int. Cl.
*F41B 5/10* (2006.01)

(52) U.S. Cl.
CPC .. *F41B 5/10* (2013.01); *F41B 5/105* (2013.01)

(58) Field of Classification Search
CPC ..... F41B 5/10; F41B 5/105; F41B 5/1403; F41B 5/123; F41B 5/1484; F41B 5/00; F41B 5/12
See application file for complete search history.

(56) References Cited

U.S. PATENT DOCUMENTS

| | | | |
|---|---|---|---|
| 4,030,473 | A | 6/1977 | Puryear |
| 4,192,281 | A | 3/1980 | King |
| 4,287,867 | A | 9/1981 | Islas |
| 4,479,480 | A | 10/1984 | Holt |
| 4,545,358 | A | 10/1985 | Collins |
| 4,565,182 | A | 1/1986 | Barnett |
| 4,587,944 | A | 5/1986 | Barnett |
| 4,693,228 | A | 9/1987 | Simonds et al. |
| 4,719,897 | A | 1/1988 | Gaudreau |
| 4,766,874 | A | 8/1988 | Nishioka |
| 4,877,008 | A | 10/1989 | Troubridge |
| 4,942,861 | A | 7/1990 | Bozek |
| 5,085,200 | A | 2/1992 | Horton-Corcoran et al. |
| 5,220,906 | A | 6/1993 | Choma |
| D337,145 | S | 7/1993 | Horton-Corcoran |
| 5,243,956 | A | 9/1993 | Luehring |
| 5,265,584 | A | 11/1993 | Judson et al. |
| 5,388,564 | A | 2/1995 | Islas |
| 5,445,139 | A | 8/1995 | Bybee |
| 5,522,373 | A | 6/1996 | Barnett |
| 5,596,976 | A | 1/1997 | Waiser |
| 5,598,829 | A | 2/1997 | Bednar |
| 5,630,405 | A | 5/1997 | Nizov |
| 5,649,520 | A | 7/1997 | Bednar |
| 5,884,614 | A | 3/1999 | Darlington et al. |
| 6,073,351 | A | 6/2000 | Barnett |
| 6,095,128 | A | 8/2000 | Bednar |
| 6,205,990 | B1 | 3/2001 | Adkins |
| 6,286,496 | B1 | 9/2001 | Bednar |
| 6,425,386 | B1 | 7/2002 | Adkins |
| 6,571,785 | B1 | 6/2003 | Choma |

(Continued)

*Primary Examiner* — Melba Bumgarner
*Assistant Examiner* — Amir Klayman

(57) ABSTRACT

A string guide for a bow having a reverse draw configuration with a draw string located adjacent a down-range side of the bow in a released configuration. First and second string guides rotate around first and second axes, respectively, as the draw string is displaced from the released configuration to the drawn configuration. A first power cable take-up journal on the first string guide rotates around the first axis to take up a power cable. The first power cable take-up journal includes a width measured along the first axis at least twice a width of the first power cable. The first power cable is biased away from at least the draw string. The first power cable is translated along the first power cable take-up journal as the bow is drawn from the released configuration to the drawn configuration.

20 Claims, 12 Drawing Sheets

(56) References Cited

U.S. PATENT DOCUMENTS

| | | | | |
|---|---|---|---|---|
| 6,651,641 | B1 | 11/2003 | Bower et al. | |
| 6,705,304 | B1 | 3/2004 | Pauluhn | |
| 6,712,057 | B2 | 3/2004 | Andrews | |
| 6,736,123 | B1 | 5/2004 | Summers et al. | |
| 6,776,148 | B1 | 8/2004 | Islas | |
| 6,786,214 | B2 | 9/2004 | Andrews | |
| 6,799,566 | B1 | 10/2004 | Malucelli | |
| 6,901,921 | B1 | 6/2005 | Barnett | |
| 6,913,007 | B2 | 7/2005 | Bednar | |
| 7,174,884 | B2 | 2/2007 | Kempf et al. | |
| 7,204,242 | B2 | 4/2007 | Dziekan | |
| 7,305,979 | B1 | 12/2007 | Yehle | |
| 7,328,693 | B2 | 2/2008 | Kempf | |
| 7,363,921 | B2 | 4/2008 | Kempf | |
| D589,578 | S | 3/2009 | Choma | |
| D590,907 | S | 4/2009 | Barnett | |
| 7,624,724 | B2 | 12/2009 | Bednar et al. | |
| 7,624,725 | B1 | 12/2009 | Choma | |
| 7,677,233 | B2 | 3/2010 | Bednar | |
| 7,708,001 | B2 | 5/2010 | Kempf | |
| 7,743,760 | B2 | 6/2010 | Woodland | |
| 7,748,370 | B1 | 7/2010 | Choma | |
| 7,770,567 | B1 | 8/2010 | Yehle | |
| 7,810,480 | B2 | 10/2010 | Shepley et al. | |
| 7,836,871 | B2 | 11/2010 | Kempf | |
| 7,938,108 | B2 * | 5/2011 | Popov | F41B 5/123 124/25 |
| 7,997,258 | B2 | 8/2011 | Shepley et al. | |
| 8,016,703 | B1 | 9/2011 | Kronengold et al. | |
| 8,020,543 | B2 | 9/2011 | Maleski et al. | |
| 8,033,275 | B2 | 10/2011 | Bednar et al. | |
| 8,042,530 | B2 | 10/2011 | Barnett | |
| 8,091,540 | B2 | 1/2012 | Matasic et al. | |
| 8,104,461 | B2 | 1/2012 | Kempf | |
| 8,240,299 | B2 | 8/2012 | Kronengold et al. | |
| 8,651,095 | B2 | 2/2014 | Islas | |
| 8,899,217 | B2 | 12/2014 | Islas | |
| 2005/0022799 | A1 | 2/2005 | Bednar | |
| 2006/0081232 | A1 * | 4/2006 | Woodland | F41B 5/0094 124/25.6 |
| 2007/0028907 | A1 | 2/2007 | Bednar et al. | |
| 2009/0178657 | A1 | 7/2009 | Shaffer | |
| 2009/0194086 | A1 | 8/2009 | Kempf | |
| 2010/0012108 | A1 | 1/2010 | Bednar et al. | |
| 2010/0031945 | A1 | 2/2010 | Shaffer et al. | |
| 2010/0154768 | A1 | 6/2010 | Bednar et al. | |
| 2010/0170487 | A1 | 7/2010 | Kronengold et al. | |
| 2010/0170488 | A1 | 7/2010 | Rasor et al. | |
| 2010/0186728 | A1 | 7/2010 | Bednar et al. | |
| 2010/0269807 | A1 | 10/2010 | Kempf | |
| 2011/0030666 | A1 * | 2/2011 | Darlington | F41B 5/105 124/25 |
| 2011/0203561 | A1 | 8/2011 | Shaffer et al. | |
| 2011/0232619 | A1 | 9/2011 | Bednar et al. | |
| 2011/0253118 | A1 | 10/2011 | Kempf | |
| 2011/0308508 | A1 | 12/2011 | Islas | |
| 2012/0006311 | A1 | 1/2012 | Bednar et al. | |
| 2013/0213372 | A1 * | 8/2013 | Biafore, Jr. | F41B 5/123 124/25 |

* cited by examiner

STRING GUIDE SYSTEM FOR A BOW

FIELD OF THE INVENTION

The present disclosure is directed to a string guide system for a bow that permits greater rotation of the cams and pulleys, permitting a longer power stroke.

BACKGROUND OF THE INVENTION

Bows have been used for many years as a weapon for hunting and target shooting. More advanced bows include cams that increase the mechanical advantage associated with the draw of the bowstring. The cams are configured to yield a decrease in draw force near full draw. Such cams preferably use power cables that load the bow limbs. Power cables can also be used to synchronize rotation of the cams, such as disclosed in U.S. Pat. No. 7,305,979 (Yehle).

With conventional bows and crossbows the draw string is typically pulled away from the generally concave area between the limbs and away from the riser and limbs. This design limits the power stroke for bows and crossbows.

In order to increase the power stroke, the draw string can be positioned on the down-range side of the string guides so that the draw string unrolls between the string guides toward the user as the bow is drawn, such as illustrated in U.S. Pat. No. 7,836,871 (Kempf) and U.S. Pat. No. 7,328,693 (Kempf). One drawback of this configuration is that the power cables can limit the rotation of the cams to about 270 degrees. In order to increase the length of the power stroke, the diameter of the pulleys needs to be increased. Increasing the size of the pulleys results in a larger and less usable bow.

FIGS. 1-3 illustrate a string guide system for a bow that includes power cables 20A, 20B ("20") attached to respective string guides 22A, 22B ("22") at first attachment points 24A, 24B ("24"). The second ends 26A, 26B ("26") of the power cables 20 are attached to the axles 28A, 28B ("28") of the opposite string guides 22. Draw string 30 engages down-range edges 46A, 46B of string guides 22 and is attached at draw string attachment points 44A, 44B ("44")

As the draw string 30 is moved from released configuration 32 of FIG. 1 to drawn configuration 34 of FIGS. 2 and 3, the string guides 22 counter-rotate toward each other about 270 degrees. The draw string 30 unwinds between the string guides 22 from opposing cam journals 48A, 48B ("48") in what is referred to as a reverse draw configuration. As the first attachment points 24 rotate in direction 36, the power cables 20 are wrapped around respective power cable take-up journal of the string guides 22, which in turn bends the limbs toward each other to store the energy needed for the bow to fire the arrow.

Further rotation of the string guides 22 in the direction 36 causes the power cables 20 to contact the power cable take-up journal, stopping rotation of the cam. The first attachment points 24 may also contact the power cables 20 at the locations 38A, 38B ("38"), preventing further rotation in the direction 36. As a result, rotation of the string guides 22 is limited to about 270 degrees, reducing the length 40 of the power stroke.

BRIEF SUMMARY OF THE INVENTION

The present disclosure is directed to a string guide system for a bow that permits greater rotation of the string guides and a longer power stroke.

The present disclosure is also directed to an archery bow with a central portion having a down-range side and an up-range side. First and second flexible limbs attached to the central portion. A first string guide is mounted to the first bow limb and rotatable around a first axis. The first string guide includes a first draw string journal and a first power cable take-up journal, both oriented generally perpendicular to the first axis. The first power cable take-up journal includes a width measured along the first axis at least twice a width of a first power cable. A second string guide is mounted to the second bow limb and rotatable around a second axis. The second string guide includes a second draw string journal oriented generally perpendicular to the second axis. A draw string is received in the first and second draw string journals and secured to the archery bow in a reverse draw configuration with the draw string adjacent the down-range side in a release configuration. The draw string translates from the down-range side toward the up-range side and unwinds between the first and second string guides in a drawn configuration. A first power cable is received in the first power cable take-up journal and secured to the archery bow. The first power cable wraps onto the first power cable take-up journal and translates along the first power cable take-up journal away from the first draw string journal as the bow is drawn from the released configuration to the drawn configuration.

In one embodiment, a biasing force translates the first power cable away from the first draw string journal as the bow is drawn from the released configuration to the drawn configuration. In another embodiment, the first power cable take-up journal includes a helical journal that translates the first power cable away from the first draw string journal as the bow is drawn from the released configuration to the drawn configuration.

In another embodiment, the second string guides include a second draw string journal and a second power cable take-up journal, both oriented generally perpendicular to the second axis. The second power cable take-up journal includes a width measured along the second axis at least twice a width of a second power cable. A second power cable is received in the second power cable take-up journal and secured to the archery bow. The second power cable wraps onto the second power cable take-up journal and translates along the second power cable take-up journal away from the second draw string journal as the bow is drawn from the released configuration to the drawn configuration. In one embodiment, the power cables preferably do not cross over the center support.

The first and second string guides rotate more than 270 degrees, and preferably more than 360 degrees, when the bow is drawn from the release configuration to the drawing configuration.

The present disclosure is also directed to a method of operating a bow having a reverse draw configuration with a draw string located adjacent a down-range side of the string guide in a released configuration. The method includes displacing the draw string from the down-range side to a drawn configuration with the draw string located at an up-range side of the string guide. First and second string guides rotate around first and second axes, respectively, as the draw string is displaced from the released configuration to the drawn configuration. A first power cable take-up journal on the first string guide rotates around the first axis to take up a power cable as the bow is drawn from the released configuration to the drawn configuration. The first power cable take-up journal includes a width measured along the first axis at least twice a width of the first power cable. The first power cable is biased away from at least the draw string. The first power cable is translated along the first power cable take-up journal as the bow is drawn from the released configuration to the drawn configuration.

In one embodiment, the first power cable is translated away from the draw string by winding it on a helical journal.

DETAILED DESCRIPTION OF THE INVENTION

Figure 1:
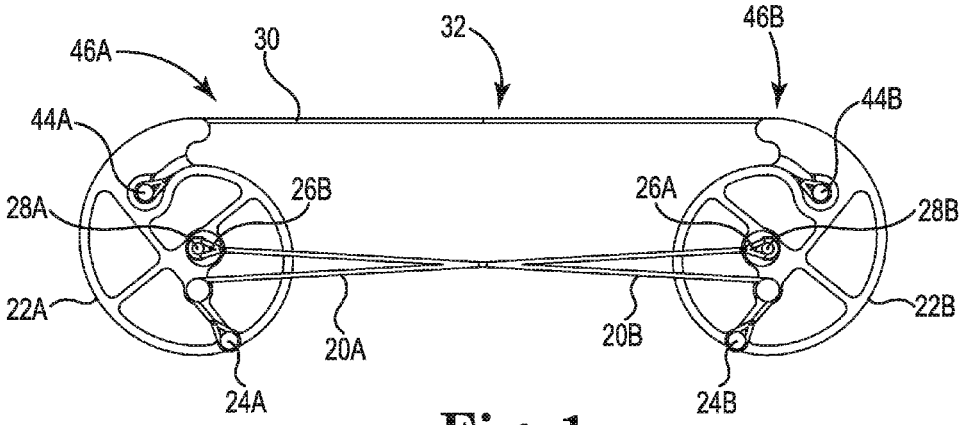
Fig. 1 PRIOR ART
FIG. 1 is a bottom view of a prior art string guide system for a bow in a release configuration.
Figure 2:
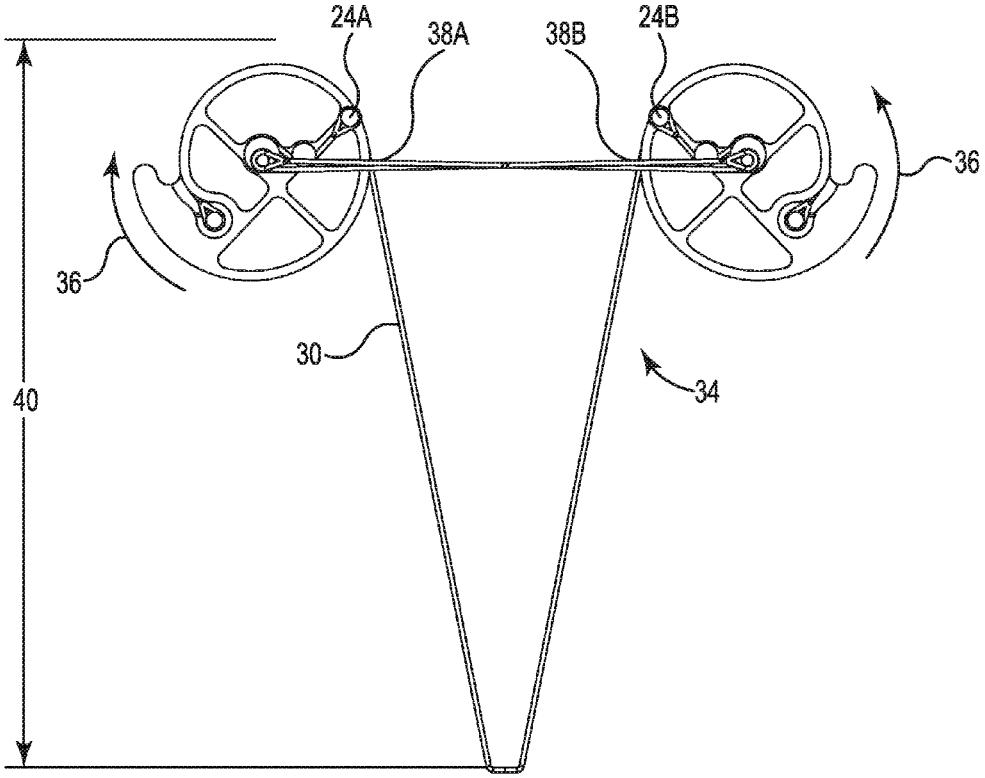
Fig. 2 PRIOR ART
FIG. 2 is a bottom view of the string guide system of FIG. 1 in a drawn configuration.
Figure 3:
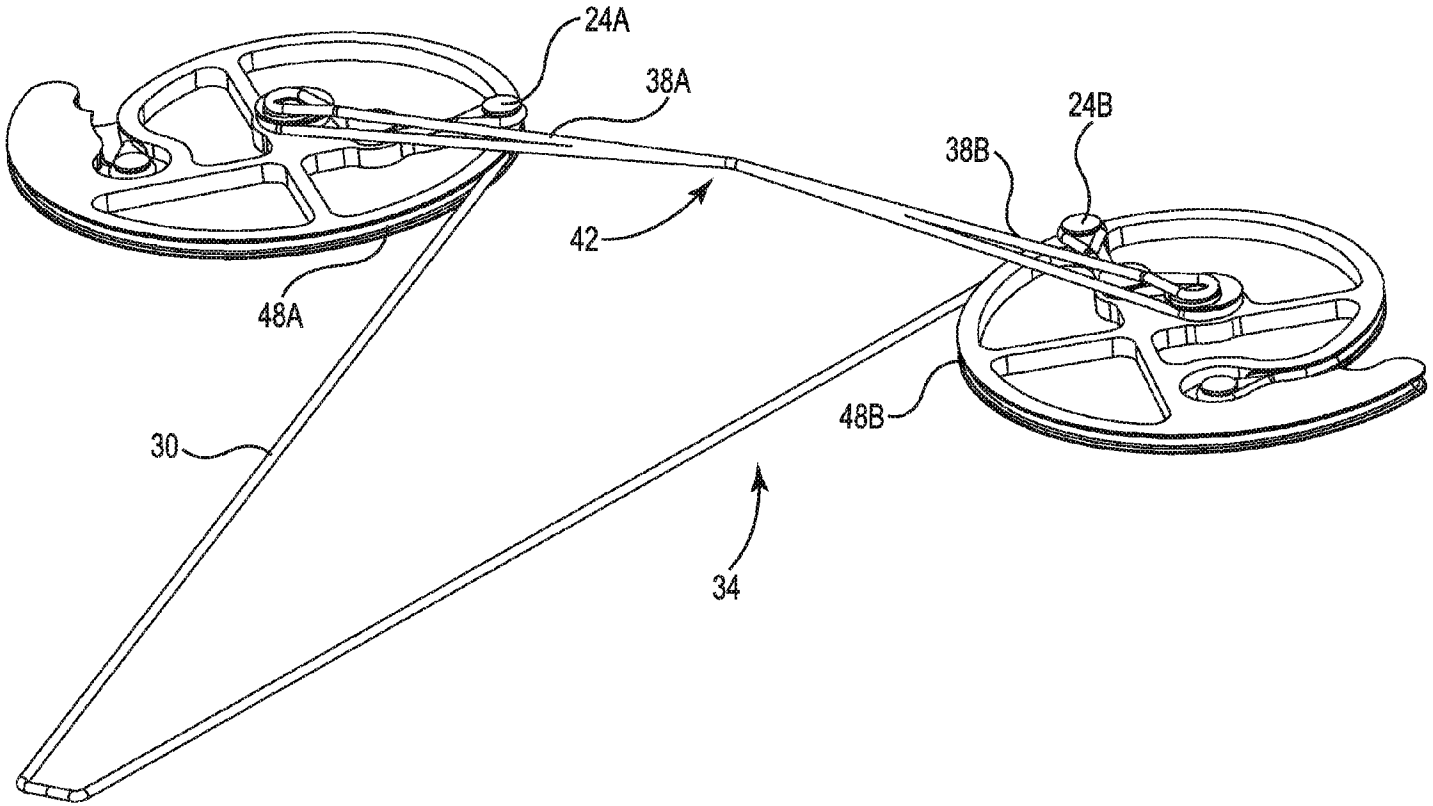
Fig. 3 PRIOR ART
FIG. 3 is a perspective view of the string guide system of FIG. 1 in a drawn configuration.
Figure 4:
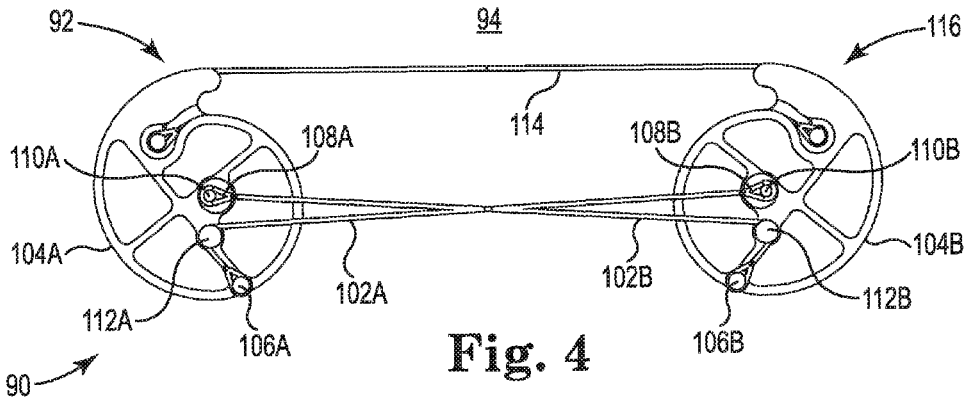
FIG. 4 is a bottom view of a string guide system for a bow with a helical take-up journal in accordance with an embodiment of the present disclosure.

FIG. 4 illustrates a string guide system 90 for a bow with a reverse draw configuration 92 in accordance with an embodiment of the present disclosure. Power cables 102A, 102B ("102") are attached to respective string guides 104A, 104B ("104") at first attachment points 106A, 106B ("106"). Second ends 108A, 108B ("108") of the power cables 102 are attached to axles 110A, 110B ("110") of the opposite string guides 104. In the illustrated embodiment, the power cables 102 wrap around power cable take-ups 112A, 112B ("112") located on the respective cam assembles 104 when in the released configuration 116 of FIG. 4.

In the reverse draw configuration 92 the draw string 114 is located adjacent down-range side 94 of the string guide system 70 when in the released configuration 116. In the released configuration 116 of FIG. 4, the distance between the axles 110 may be in the range of less than about 16 inches to less than about 10 inches. In the drawn configuration 118, the distance between the axles 110 may be in the range of about 14 inches to about 8 inches.

Figure 5:
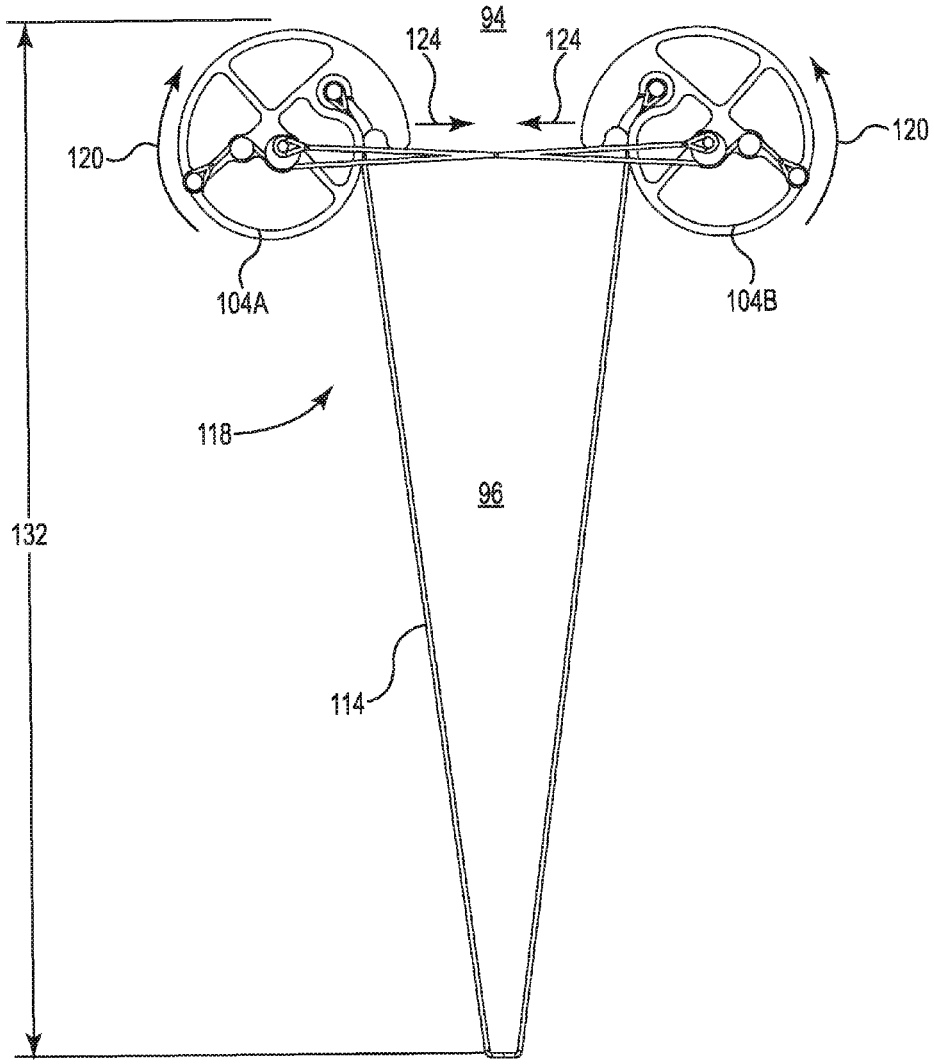
FIG. 5 is a bottom view of the string guide system of FIG. 4 in a drawn configuration.
Figure 6:
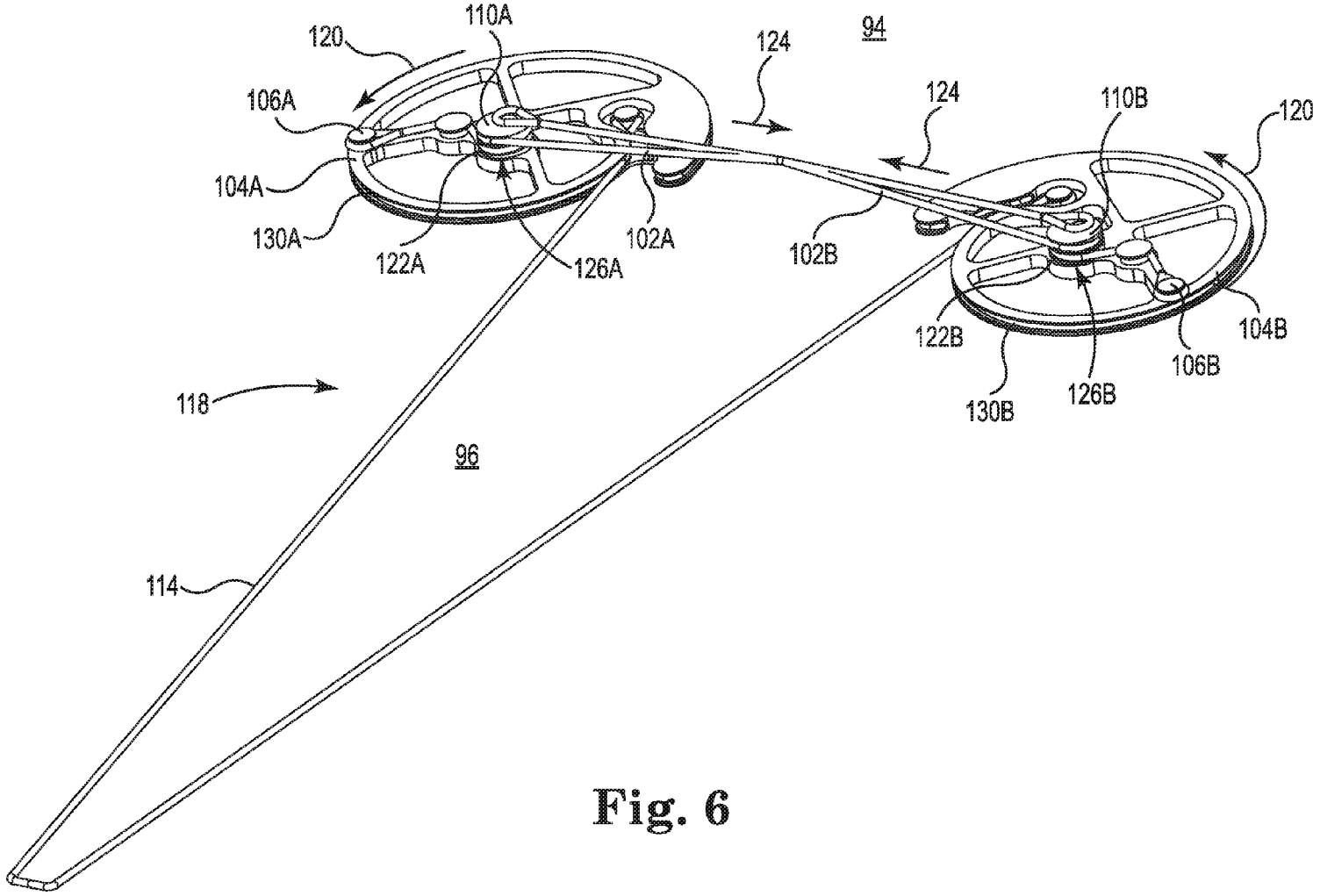
FIG. 6 is a perspective view of the string guide system of FIG. 4 in a drawn configuration.

As illustrated in FIGS. 5 and 6, the draw string 114 translates from the down-range side 94 toward the up-range side 96 and unwinds between the first and second string guides 104 in a drawn configuration 118. In the illustrated embodiment, the string guides 104 counter-rotate toward each other in directions 120 more than 360 degrees as the draw string 114 unwinds between the string guides 104 from opposing cam journals 130A, 130B ("130").

The string guides 104 each include one or more grooves, channels or journals located between two flanges around at least a portion of its circumference that guides a flexible member, such as a rope, string, belt, chain, and the like. The string guides can be cams or pulleys with a variety of round and non-round shapes. The axis of rotation can be located concentrically or eccentrically relative to the string guides. The power cables and draw strings can be any elongated flexible member, such as woven and non-woven filaments of synthetic or natural materials, cables, belts, chains, and the like.

As the first attachment points 106 rotate in direction 120, the power cables 102 are wrapped onto cams 126A, 126B ("126") with helical journals 122A, 122B ("122"), preferably located at the respective axles 110. The helical journals 122 take up excess slack in the power cables 102 resulting from the string guides 104 moving toward each other in direction 124 as the axles 110 move toward each other.

Figure 7:
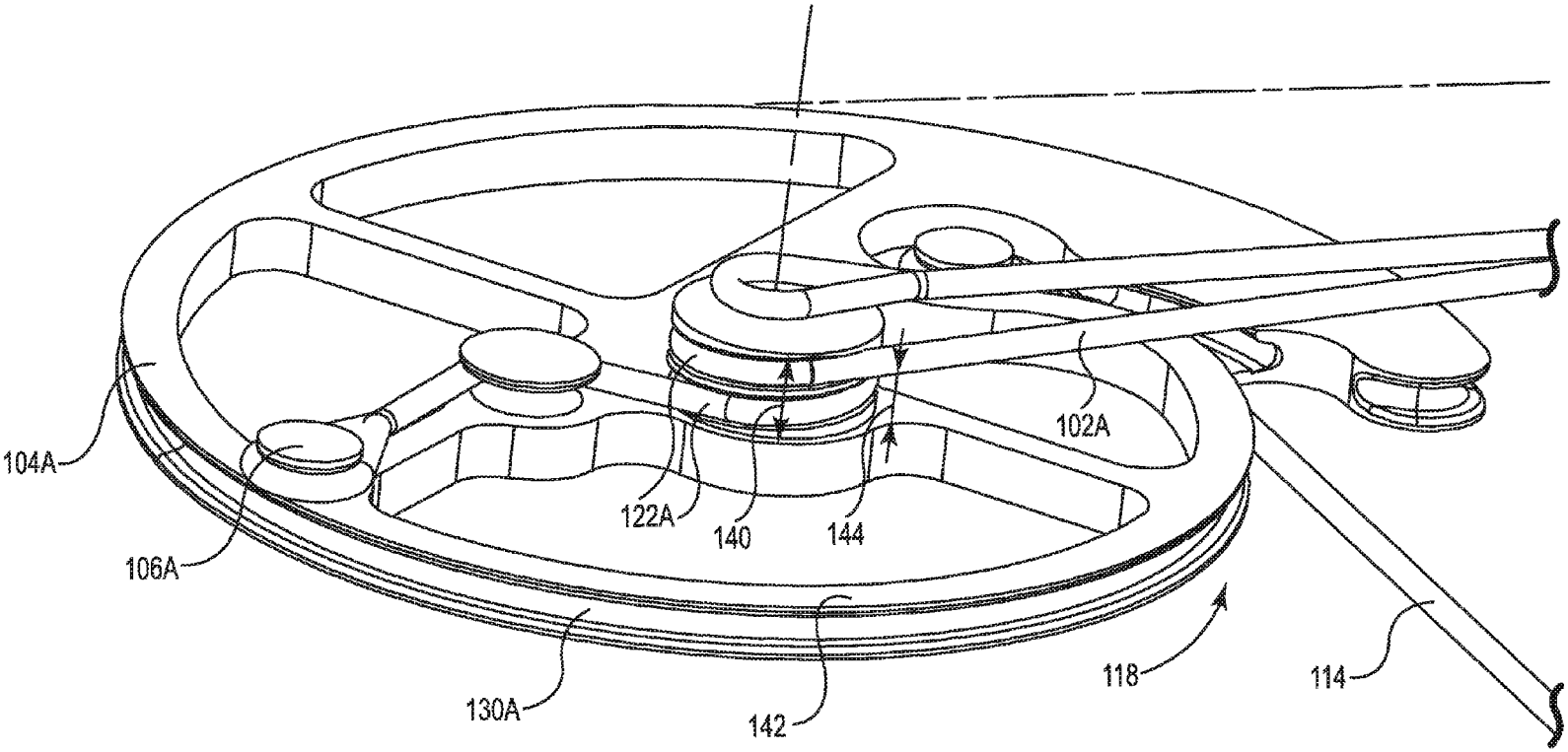
FIG. 7 is an enlarged view of the left string guide of the string guide system of FIG. 4.
Figure 8:
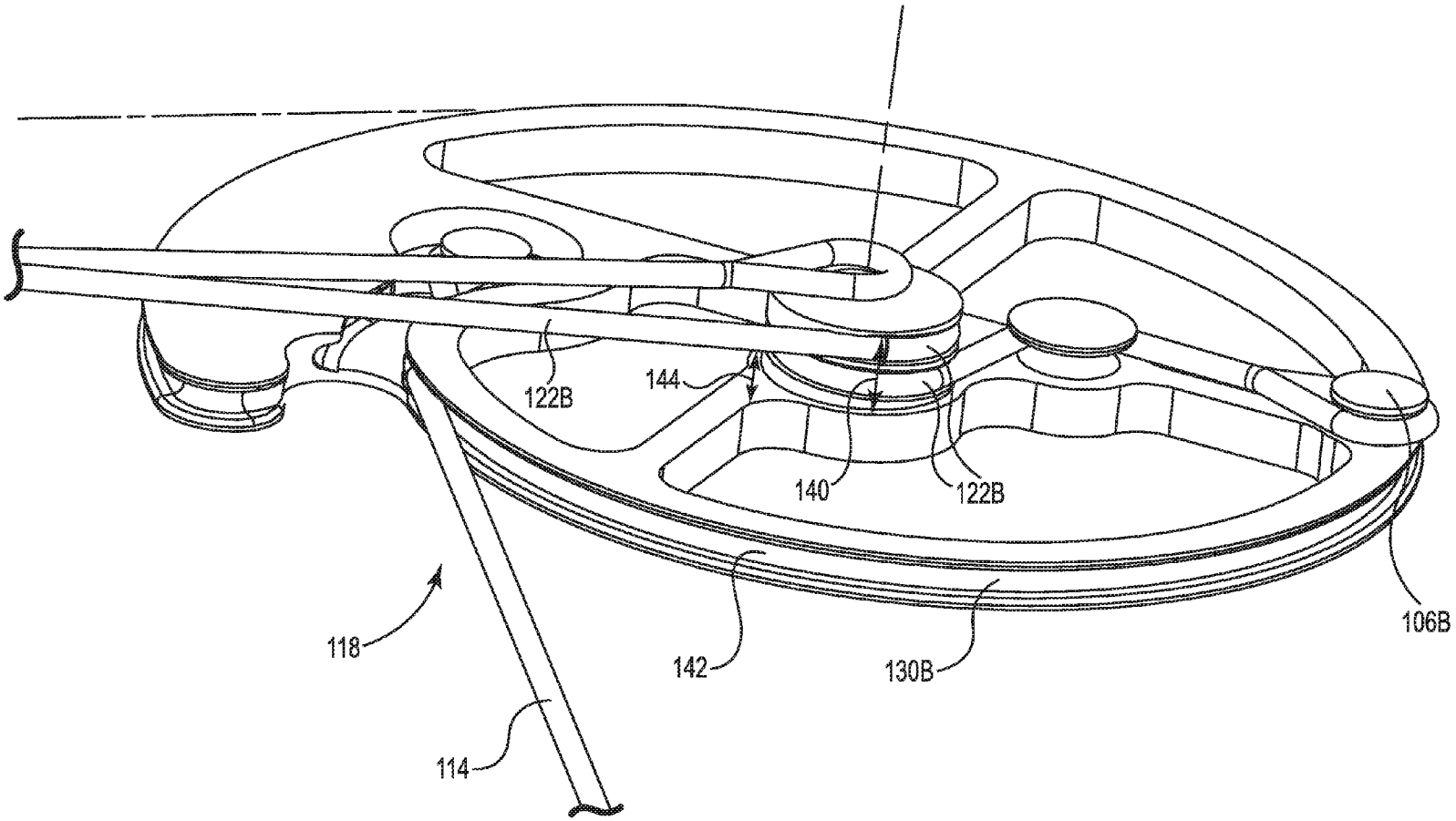
FIG. 8 is an enlarged view of the right string guide of the string guide system of FIG. 4.

The helical journals 122 serve to displace the power cables 102 away from the string guides 104, so the first attachment points 106 do not contact the power cables 102 while the bow is being drawn (see FIGS. 7 and 8). As a result, rotation of the string guides 104 is limited only by the length of the draw string journals 130A, 103B ("130"). For example, the draw string journals 130 can also be helically in nature, wrapping around the axles 110 more than 360 degrees.

As a result, the power stroke 132 is extended. In the illustrated embodiment, the power stroke 132 can be increased by at least 25%, and preferably by 40% or more, without changing the diameter of the string guides 104.

In some embodiments, the geometric profiles of the draw string journals 130 and the helical journals 122 contribute to let-off at full draw. A more detailed discussion of cams suitable for use in bows is provided in U.S. Pat. No. 7,305,979 (Yehle), which is hereby incorporated by reference.

FIGS. 7 and 8 are enlarged views of the string guides 104A, 104B, respectively, with the draw string 114 in the drawn configuration 118. The helical journals 122 have a length corresponding generally to one full wrap of the power cables 102. The axes of rotation 146A, 146B ("146") of the first and second helical journals 122 preferably extend generally perpendicular to a plane of rotation of the first and second string guides 104. The helical journals 122 displace the power cables 102 away from the draw string 114 as the bow is drawn from the released configuration 116 to the drawn configuration 118. Height 140 of the helical journals 122 raises the power cables 102 above top surface 142 of the string guides 104. The resulting gap 144 permits the first attachment points 106 and the power cable take-ups 112 to pass freely under the power cables 102. The length of the helical journals 122 can be increased or decreased to optimize draw force versus draw distance for the bow and let-off. The axes of rotation 146 of the helical journals 122 are preferably co-linear with axes 110 of rotation for the string guides 104.

Figure 9A:
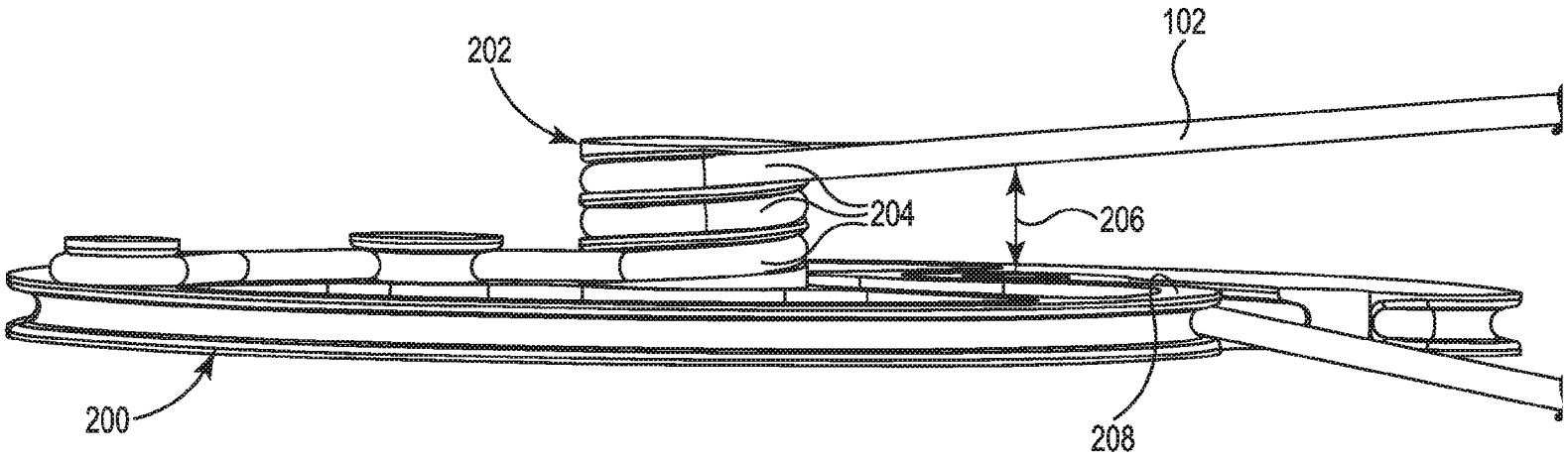
FIG. 9A is an enlarged view of a power cable take-up journal sized to receive two full wraps of the power cable in accordance with an embodiment of the present disclosure.

FIG. 9A illustrates an alternate string guide 200 in accordance with an embodiment of the present disclosure. Power cable take-ups 202 have helical journals 204 that permit the power cables 102 to wrap around about two full turns or about 720 degrees. The extended power cable take-up 202 increases the gap 206 between the power cables 102 and top surface 208 of the string guide 200 and provides excess capacity to accommodate more than 360 degrees of rotation of the string guides 200.

Figure 9B:
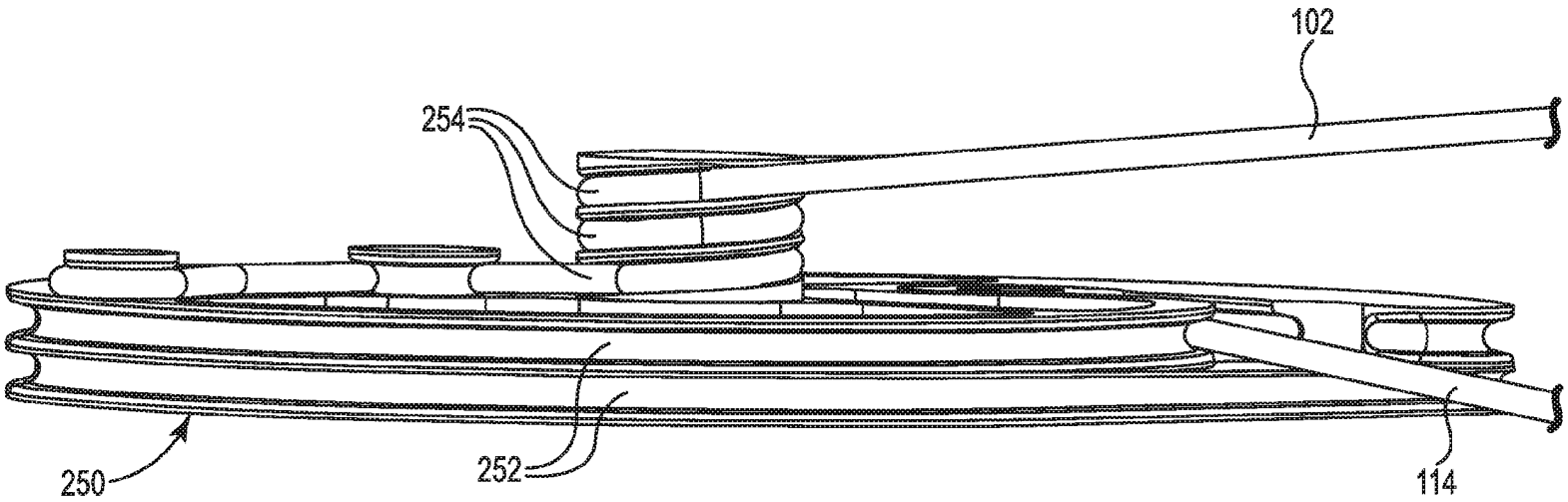
FIG. 9B is an enlarged view of a power cable take-up journal and draw string journal sized to receive two full wraps of the power cable and draw string in accordance with an embodiment of the present disclosure.

FIG. 9B illustrates an alternate string guide 250 in accordance with an embodiment of the present disclosure. The draw string journals 252 and the power cable journals 254 are both helical structures designed so that the draw string 114 and the power cables 102 can wrap two full turns around the string guide 250.

Figure 9C:
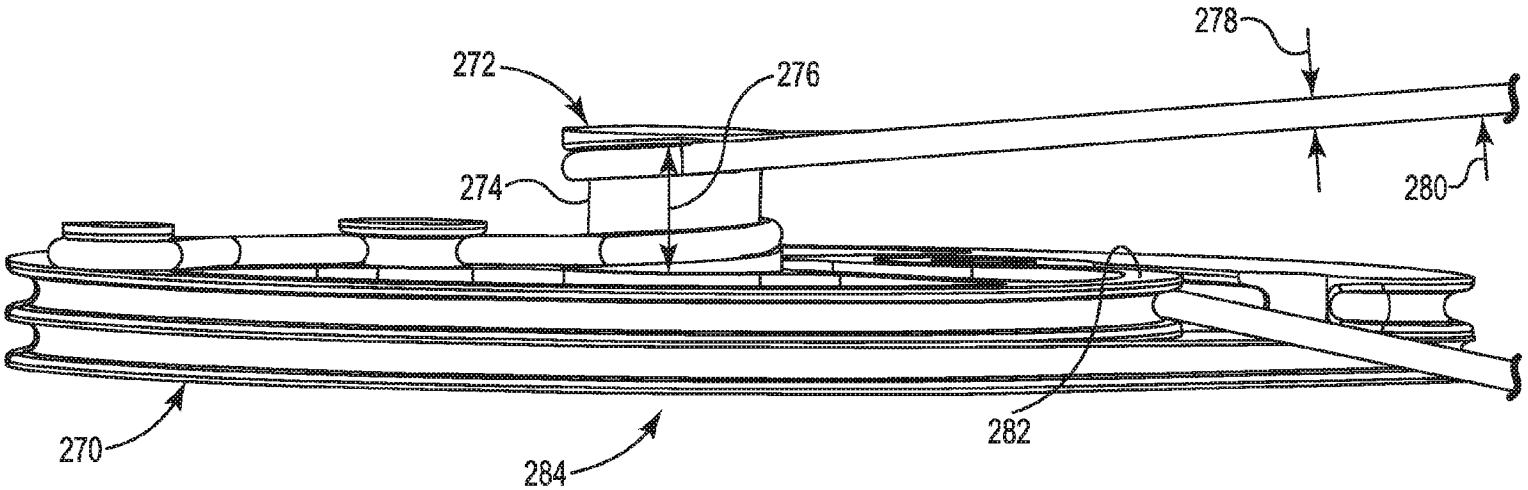
FIG. 9C is an enlarged view of an elongated power cable take-up journal in accordance with an embodiment of the present disclosure.

FIG. 9C illustrates an alternate string guide 270 with a smooth power cable take-up 272 in accordance with an embodiment of the present disclosure. The power cable take-up 272 has a surface 274 with a height 276 at least twice a diameter 278 of the power cable 102. In another embodiment, the surface 274 has a height 276 at least three times the diameter 278 of the power cable 102. Biasing force 280, such as from a cable guard located on the bow shifts the power cables 102 along the surface 274 away from top surface 282 of the string guide 270 when in the drawn configuration 284.

Figure 10:
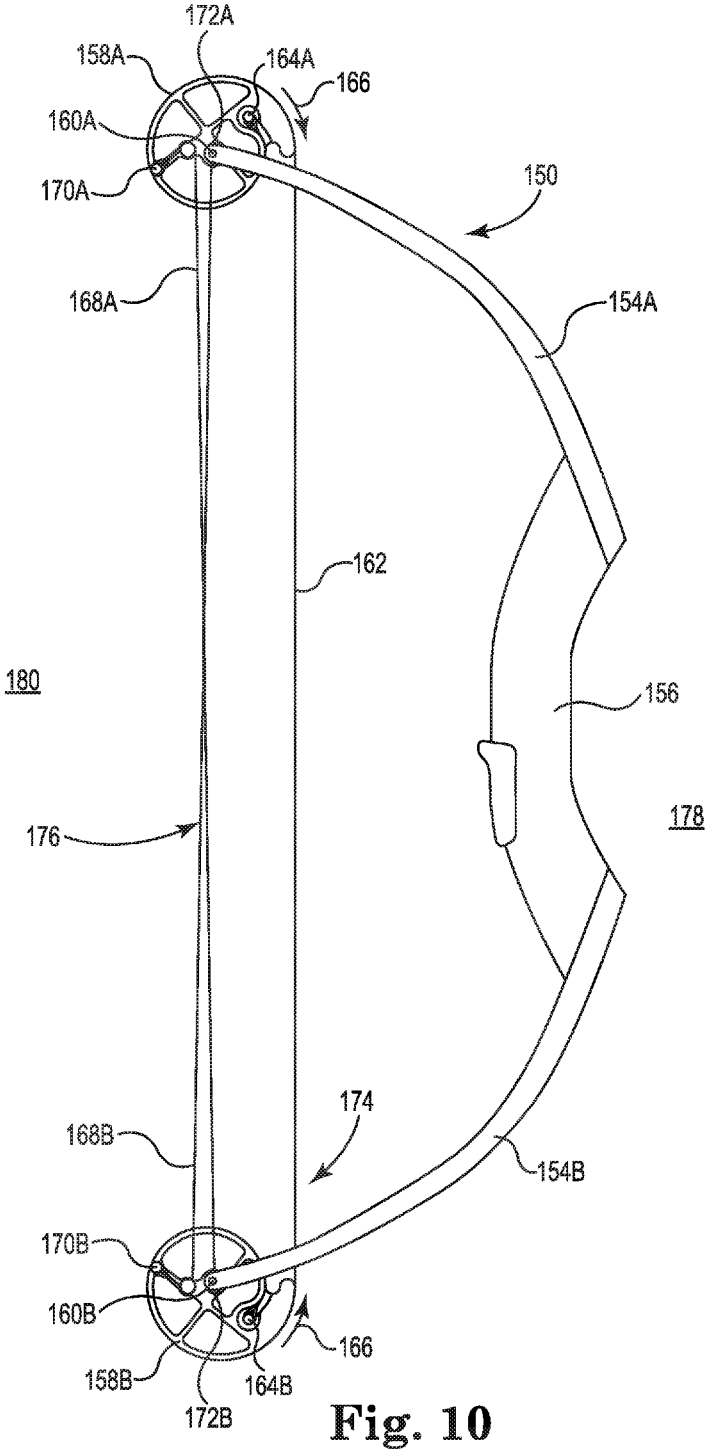
FIG. 10 is a schematic illustration of a bow with a string guide system in accordance with an embodiment of the present disclosure.

FIG. 10 is a schematic illustration of bow 150 with a string guide system 152 in accordance with an embodiment of the present disclosure. Bow limbs 154A, 154B ("154") extend oppositely from handle 156. String guides 158A, 158B ("158") are rotatably mounted, typically eccentrically, on respective limbs 154A, 154B on respective axles 160A, 160B ("160") in a reverse draw configuration 174.

Draw string 162 is received in respective draw string journals (see e.g., FIGS. 7 and 8) and secured at each end to the string guides 158 at locations 164A, 164B. When the bow is in the release configuration 176 illustrated in FIG. 10, the draw string 162 is located adjacent the down-range side 178 of the bow 150. When the bow 150 is drawn, the draw string 162 unwinds from the draw string journals toward the up-range side 180 of the bow 150, thereby rotating the string guides 158 in direction 166.

First power cable 168A is secured to the first string guide 158A at first attachment point 170A and engages with a power cable take-up with a helical journal 172A (see FIGS. 7 and 8) as the bow 150 is drawn. As the string guide 158A rotates in the direction 166, the power cable 168A is taken up by the cam 172A. The other end of the first power cable 168A is secured to the axle 160B.

Second power cable 168B is secured to the second string guide 158B at first attachment point 170B and engages with a power cable take-up with a helical journal 172B (see FIGS. 7 and 8) as the bow 150 is drawn. As the string guide 158B rotates, the power cable 168B is taken up by the cam 172B. The other end of the second power cable 168B is secured to the axle 160A. The power cable take-ups 172 are arranged so that as the bow 150 is drawn, the bow limbs 154 are drawn toward one another.

Figure 11:
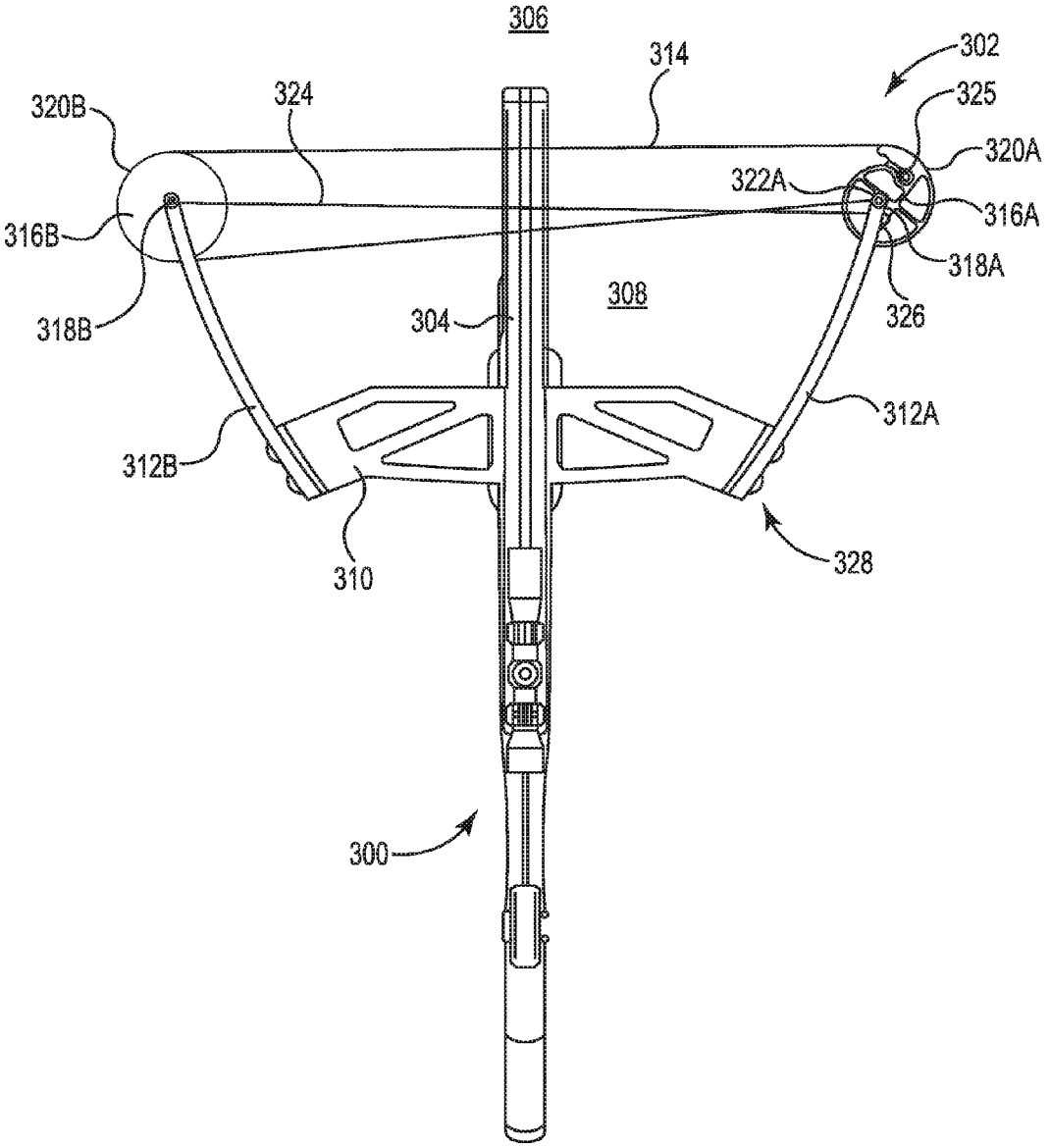
FIG. 11 is a schematic illustration of an alternate bow with a string guide system in accordance with an embodiment of the present disclosure.

FIG. 11 is a schematic illustration of a crossbow 300 with a reverse draw configuration 302 in accordance with an embodiment of the present disclosure. The crossbow 300 includes a center portion 304 with down-range side 306 and up-range side 308. In the illustrated embodiment, the center portion 304 includes riser 310. First and second flexible limbs 312A, 312B ("312") are attached to the riser 310 and extend from opposite sides of the center portion 304.

Draw string 314 extends between first and second string guides 316A, 316B ("316"). In the illustrated embodiment, the string guide 316A is substantially as shown in FIGS. 4-8, while the string guide 316B is a conventional pulley.

The first string guide 316A is mounted to the first bow limb 312A and is rotatable around a first axis 318A. The first string guide 316A includes a first draw string journal 320A and a first power cable take-up journal 322A, both of which are oriented generally perpendicular to the first axis 318A. (See e.g., FIG. 8). The first power cable take-up journal 322A includes a width measured along the first axis 318A that is at least twice a width of power cable 324.

The second string guide 316B is mounted to the second bow limb 312A and rotatable around a second axis 318B. The second string guide 316B includes a second draw string journal 320B oriented generally perpendicular to the second axis 318B.

The draw string 314 is received in the first and second draw string journals 320A, 320B and is secured to the first string guide 316A at first attachment point 325. The draw string extends adjacent to the down-range side 306 to the second string guide 316B, wraps around the second string guide 316B, and is attached at the first axis 318A.

Power cable 324 is attached to the string guide 316A at attachment point 326. See FIG. 4. Opposite end of the power cable 324 is attached to the axis 318B. In the illustrated embodiment, power cable 324 wraps onto the first power cable take-up journal 322A and translates along the first power cable take-up journal 322A away from the first draw string journal 320A as the bow 300 is drawn from the released configuration 328 to the drawn configuration (see FIGS. 5-8).

Figure 12:
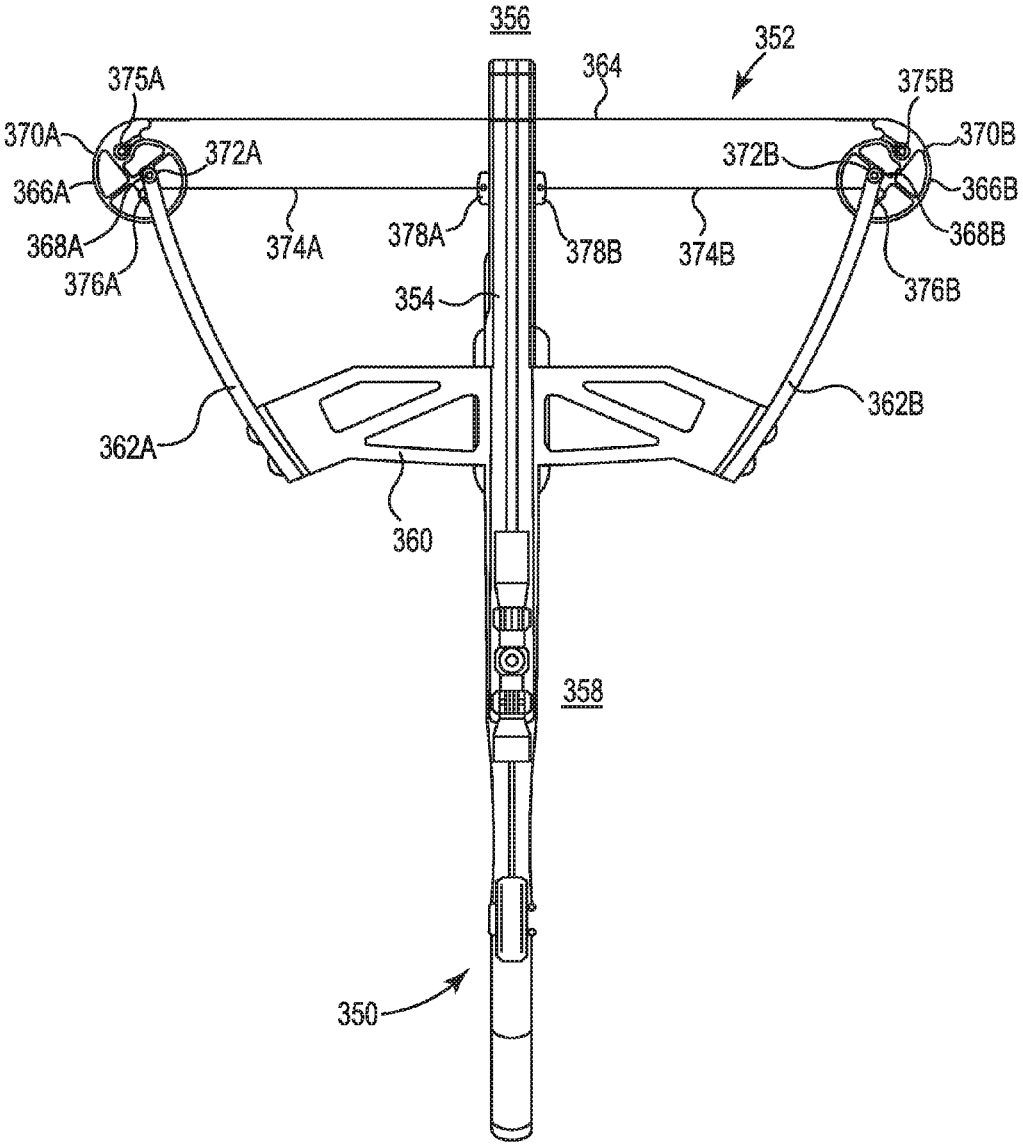
FIG. 12 is a schematic illustration of an alternate dual-cam bow with a string guide system in accordance with an embodiment of the present disclosure.

FIG. 12 is a schematic illustration of a dual-cam crossbow 350 with a reverse draw configuration 352 in accordance with an embodiment of the present disclosure. The crossbow 350 includes a center portion 354 with down-range side 356 and up-range side 358. First and second flexible limbs 362A, 362B ("362") are attached to riser 360 and extend from opposite sides of the center portion 354. Draw string 364 extends between first and second string guides 366A, 366B ("366"). In the illustrated embodiment, the string guides 366 are substantially as shown in FIGS. 4-8.

The string guides 366 are mounted to the bow limb 362 and are rotatable around first and second axis 368A, 368B ("368"), respectively. The string guides 366 include first and second draw string journals 370A, 370B ("370") and first and second power cable take-up journals 372A, 372B ("372"), both of which are oriented generally perpendicular to the axes 368, respectively. (See e.g., FIG. 8). The power cable take-up journals 372 include widths measured along the axes 368 that is at least twice a width of power cables 374A, 374B ("374").

The draw string 364 is received in the draw string journals 370 and is secured to the string guides 316 at first and second attachment points 375A, 375B ("325").

Power cables 374 are attached to the string guides 316 at attachment points 376A, 376B ("376"). See FIG. 4. Opposite ends 380A, 380B ("380") of the power cables 374 are attached to anchors 378A, 378B ("378") on the center portion 354. The power cables 374 preferably do not cross over the center support 354.

In the illustrated embodiment, power cables wrap 374 onto the power cable take-up journal 372 and translates along the power cable take-up journals 372 away from the draw string journals 370 as the bow 350 is drawn from the released configuration 378 to the drawn configuration (see FIGS. 5-8).

The string guides disclosed herein can be used with a variety of bows and crossbows, including those disclosed in commonly assigned U.S. patent application Ser. No. 13/799,518, entitled Energy Storage Device for a Bow, filed Mar. 13, 2013 and Ser. No. 14/071,723, entitled DeCocking Mechanism for a Bow, filed Nov. 5, 2013, both of which are hereby incorporated by reference.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A crossbow, comprising:

a central portion comprising a down-range side and an up-range side;

first and second flexible limbs attached to the central portion;

a first string guide mounted to the first bow limb and rotatable around a first axis, the first string guide comprising a first draw string journal having a first plane of rotation perpendicular to the first axis, and a first helical power cable take-up journal extending in a direction perpendicular to the first plane of rotation of the first draw string journal;

a second string guide mounted to the second bow limb and rotatable around a second axis, the second string guide comprising a second draw string journal having a second plane of rotation perpendicular to the second axis, and a second helical power cable take-up journal extending in a direction perpendicular to the second plane of rotation of the second draw string journal;

a draw string received in the first and second draw string journals and secured to the crossbow in a reverse draw configuration with the draw string adjacent the down-range side of the string guides in a released configuration, wherein the draw string translates from the down-range side toward the up-range side and unwinds between the first and second string, guides to a drawn configuration;

a first power cable received in the first helical power cable take-up journal; and a second power cable received in the second helical power cable take-up journal, wherein as the bow is drawn from the released configuration to the drawn configuration the first and second power cables wrap onto the first and second helical, power cable take-up journals and are displaced along the first and second axes away from the first and second planes of rotation of the first and second draw string journals, respectively.

2. The crossbow of claim 1 wherein the first and second power cables include first ends secured to the first and second string guides, respectively, and a second ends secured to the central portion of the crossbow.

3. The crossbow of claim 1 wherein the first and second power cables do not cross over the central portion.

4. The crossbow of claim 1 wherein the first and second planes of rotation of the first and second string guides are co-planar.

5. The crossbow of claim 1 wherein the first and second helical power cable take-up journals wrap around the first and second axes in directions perpendicular to the first and second planes of rotation of the first and second draw string journals, respectively.

6. The crossbow of claim 1 wherein the first and second helical power cable take-up journals comprise lengths that accommodates more than 360 degrees of rotation of the first and second string guides.

7. The crossbow of claim 1 wherein the first and second draw string journals comprise lengths that accommodates more than 360 degrees of rotation of the first and second string guides.

8. The crossbow of claim 1 wherein the first and second string guides rotate more than 270 degrees when the bow is drawn from the released configuration to the drawing configuration.

9. The crossbow of claim 1 wherein the first and second string guides rotate more than 360 degrees when the bow is drawn from the released configuration to the drawing configuration.

10. The crossbow of claim 1 wherein the first power cable includes a first end secured to the first draw string guide and a second end secured to the second axis.

11. A crossbow, comprising:

a central portion comprising a down-range side and an up-range side;

first and second flexible limbs attached to the central portion;

a first string guide mounted to the first bow limb and rotatable around a first axis, the first string guide comprising a first draw string journal having a first plane of rotation perpendicular to the first axis, and a first power cable take-up journal extending around the first axis in a direction perpendicular to the first plane of rotation of the first draw string journal, wherein the first power cable take-up journals comprise lengths that accommodates more than 360 degrees of rotation of the first string guide;

a second string guide mounted to the second bow limb and rotatable around a second axis, the second string guide comprising a second draw string journal having a second plane of rotation perpendicular to the second axis, and a second power cable take-up journal extending around the second axis in a direction perpendicular to the second plane of rotation of the second draw string journal, wherein the second power cable take-up journals comprise lengths that accommodates more than 360 degrees of rotation of the second string guide;

a draw string received in the first and second draw string journals and secured to the crossbow in a reverse draw configuration with the draw string adjacent the down-range side of the string guides in a released configuration, wherein the draw string translates from the down-range side toward the up-range side and unwinds between the first and second string guides to a drawn configuration;

a first power cable received in the first power cable take-up journal; and a second power cable received in the second power cable take-up journal, wherein as the bow is drawn from the released configuration to the drawn configuration the first and second power cables wrap onto the first and second power cable take-up journals and are displaced along the first and second axes away from the first and second planes of rotation of the first and second draw string journals, respectively.

12. The crossbow of claim 11 wherein the first and second power cables include first ends secured to the first and second string guides, respectively, and a second ends secured to the central portion of the crossbow.

13. The crossbow of claim 11 wherein the first and second power cables do not cross over the central portion.

14. The crossbow of claim 11 wherein the first and second draw string journals comprise lengths that accommodates more than 360 degrees of rotation of the first and second string guides.

15. The crossbow of claim 11 wherein the first and second power cable take-up journals comprises helical journals that translate the first and second power cable away from the plane of rotation of the first and second string guides as the bow is drawn from the released configuration to the drawn configuration.

16. The crossbow of claim 11 wherein a distance between the first and second axis when the bow is in the drawn configuration is about 8 inches.

17. A method of operating a crossbow having first and second flexible limbs attached to a central portion, first and second string guides mounted to the bow limbs, and a draw string journaled on the first and second string guides, the method comprising the steps of:

unwrapping the draw string from first and second draw string journals on the first and second string guides, the first and second string guides including first and second helical power cable take-up journals configured to receive first and second power cables, respectively wherein the first and second helical power cable take-up journals extending in a direction perpendicular to a rotation of the first and second draw string journals, respectively; and wrapping the first and second power cables onto the first and second helical power cable take-up journals on the first and second string guides, respectively, the first and second helical power cable take-up journals displacing the first and second power cables along first and second axes of rotation of the first and second string guides away from first and second planes of rotation of the first and second draw string journals, respectively.

18. The method of claim 17 comprising attaching first ends of the first and second power cables to the first and second string guides, respectively, and attaching second ends of the first and second power cables to the central portion.

19. The method of claim 18 comprising arranging the first and second power cables so as to not cross over the central portion.

20. The method of claim 17 comprising sizing the first and second draw string journals with lengths that accommodates more than 360 degrees of rotation of the first and second string guides.

* * * * *